US008339322B2

(12) United States Patent
Zaila et al.

(10) Patent No.: US 8,339,322 B2
(45) Date of Patent: Dec. 25, 2012

(54) COMPACT MULTI-BAND ANTENNAS

(75) Inventors: Samuel Zaila, Phoenix, AZ (US); Marin Stoytchev, Chandler, AZ (US)

(73) Assignee: Galtronics Corporation Ltd., Tiberias (IL)

( * ) Notice: Subject to any disclaimer, the term of this patent is extended or adjusted under 35 U.S.C. 154(b) by 0 days.

(21) Appl. No.: 12/677,205

(22) PCT Filed: Feb. 18, 2010

(86) PCT No.: PCT/IL2010/000145

§ 371 (c)(1),
(2), (4) Date: Mar. 9, 2010

(87) PCT Pub. No.: WO2010/095136

PCT Pub. Date: Aug. 26, 2010

(65) Prior Publication Data

US 2011/0291895 A1 Dec. 1, 2011

Related U.S. Application Data

(60) Provisional application No. 61/208,104, filed on Feb. 19, 2009.

(51) Int. Cl.
*H01Q 1/24* (2006.01)

(52) U.S. Cl. ..... 343/702; 343/722; 343/700 MS

(58) Field of Classification Search ..... 343/702, 343/700 MS, 846, 850, 722
See application file for complete search history.

(56) References Cited

U.S. PATENT DOCUMENTS

| | | | | |
|---|---|---|---|---|
| 6,429,818 | B1 | 8/2002 | Johnson et al. | |
| 6,573,867 | B1 | 6/2003 | Desclos et al. | |
| 6,661,380 | B1 | 12/2003 | Bancroft et al. | |
| 6,906,667 | B1 | 6/2005 | Poilasne et al. | |
| 7,046,202 | B2 | 5/2006 | Chiang et al. | |
| 7,830,326 | B2 * | 11/2010 | Hung et al. | 343/826 |
| 2002/0018026 | A1 | 2/2002 | Noro | |
| 2002/0180646 | A1 | 12/2002 | Kivekas et al. | |
| 2003/0184476 | A1 | 10/2003 | Skinia et al. | |
| 2003/0210193 | A1 | 11/2003 | Rossman et al. | |
| 2004/0087341 | A1 | 5/2004 | Edvardsson | |
| 2004/0125020 | A1 | 7/2004 | Hendler et al. | |
| 2005/0007293 | A1 | 1/2005 | Handelsman | |
| 2005/0235482 | A1 | 10/2005 | Deaett et al. | |
| 2006/0164308 | A1 | 7/2006 | Cohen | |
| 2007/0146212 | A1 * | 6/2007 | Ozden et al. | 343/702 |
| 2007/0268191 | A1 | 11/2007 | Ishizuka et al. | |
| 2008/0169349 | A1 | 7/2008 | Suzuki et al. | |
| 2008/0180333 | A1 | 7/2008 | Martiskainen et al. | |
| 2008/0198088 | A1 * | 8/2008 | Lin et al. | 343/850 |
| 2008/0224946 | A1 | 9/2008 | Lee et al. | |
| 2008/0258991 | A1 | 10/2008 | Montgomery et al. | |
| 2008/0278398 | A1 * | 11/2008 | Tsai et al. | 343/850 |
| 2008/0278405 | A1 | 11/2008 | Montgomery et al. | |
| 2010/0013730 | A1 | 1/2010 | Azhari | |

OTHER PUBLICATIONS

An International Preliminary Examination Report dated Apr. 11, 2011, which issued during the prosecution of Applicant's PCT/IL09/00977.

(Continued)

*Primary Examiner* — Hoang V Nguyen
(74) *Attorney, Agent, or Firm* — Sughrue Mion, PLLC

(57) ABSTRACT

A multi-band antenna including a conductive ground plane element, a conductive driven element having a feed point and a conductive coupling element located on at least one but not all sides of the conductive driven element and coupled to the conductive ground plane element and to the conductive driven element, wherein a resonant frequency associated with the conductive coupling element is independent of a size of the conductive ground plane element.

23 Claims, 9 Drawing Sheets

OTHER PUBLICATIONS

An International Preliminary Examination Report dated May 12, 2011, which issued during the prosecution of Applicant's PCT/IL09/01018.

An International Search Report dated Feb. 3, 2010, which issued during the prosecution of Applicant's PCT/IL09/01018.

An International Search Report dated Feb. 1, 2010, which issued during the prosecution of Applicant's PCT/IL09/00977.

A. Diallo, et al., "Study and Reduction of the Mutual Coupling Between Two Mobile Phone PIFAs Operating in the DCS1800 and UMTS Bands", IEEE Trans. on Antennas and Propagation, vol. 54, No. 11 Nov. 2006.

International Search Report and Written Opinion, both dated Jun. 3, 2010, for PCT/IL2010/00145, 11 pages.

* cited by examiner

COMPACT MULTI-BAND ANTENNAS

REFERENCE TO RELATED APPLICATIONS

Reference is hereby made to U.S. Provisional Patent Application 61/208,104, entitled COMPACT MULTI-BAND ANTENNAS, filed Feb. 19, 2009, the disclosure of which is hereby incorporated by reference and priority of which is hereby claimed pursuant to 37 CFR 1.78(a)(4) and (5)(i).

FIELD OF THE INVENTION

The present invention relates generally to antennas and more particularly to compact antennas capable of operating in multiple bands.

BACKGROUND OF THE INVENTION

The following patent documents are believed to represent the current state of the art:
U.S. Pat. Nos. 6,429,818, 6,573,867 and 6,661,380; and
U.S. Published Application No.: 2008/0180333

SUMMARY OF THE INVENTION

The present invention seeks to provide an improved compact multi-band antenna for use in wireless communication devices.

There is thus provided in accordance with a preferred embodiment of the present invention a multi-band antenna including a conductive ground plane element, a conductive driven element having a feed point and a conductive coupling element located on at least one but not all sides of the conductive driven element and coupled to the conductive ground plane element and to the conductive driven element, wherein a resonant frequency associated with the conductive coupling element is independent of a size of the conductive ground plane element.

In accordance with a preferred embodiment of the present invention the conductive driven element and the conductive coupling element are configured so that the conductive driven element radiates in a first frequency band and the conductive driven element together with the conductive coupling element radiate in a second frequency band.

Preferably, the first frequency band is higher than the second frequency band and the conductive driven element includes a ¼ wavelength monopole radiator.

In accordance with a preferred embodiment of the present invention the conductive coupling element is galvanically coupled to the conductive ground plane element and the resonant frequency associated with the conductive coupling element depends only on $C_{se}$ and $L_{sh}$, wherein $C_{se}$ corresponds to a coupling capacitance between the conductive driven element and the conductive coupling element and $L_{sh}$ corresponds to a shunt inductance of the conductive coupling element to the conductive ground plane element.

Preferably, the resonant frequency associated with the conductive coupling element is given by $$\frac{1}{2\pi\sqrt{C_{se}L_{sh}}}.$$

In accordance with another preferred embodiment of the present invention the conductive coupling element is capacitively coupled to the conductive ground plane element and the resonant frequency associated with the conductive coupling element depends only on $C_{se}$, $L_{sh}$ and $C_{sh}$, wherein $C_{se}$ corresponds to a coupling capacitance between the conductive driven element and the conductive coupling element, $L_{sh}$ corresponds to a shunt inductance of the conductive coupling element to the conductive ground element and $C_{sh}$ corresponds to a shunt capacitance of the conductive coupling element to the conductive ground plane element.

Preferably, the resonant frequency associated with the conductive coupling element is given by $$\frac{1}{2\pi\sqrt{C_{eff}L_{sh}}},$$

wherein $$\frac{1}{C_{eff}} = \frac{1}{C_{se}} + \frac{1}{C_{sh}}.$$

In accordance with a further preferred embodiment of the present invention the conductive driven element and the conductive coupling element are formed on a surface of a dielectric substrate.

Preferably, the dielectric substrate includes a portion of a PCB. Additionally or alternatively, the dielectric substrate includes a dielectric material selected from a group of materials including plastics, glasses and ceramics.

Preferably, the conductive driven element and the conductive coupling element are formed using a technique selected from a group of techniques including printing, plating, gluing and molding.

Preferably, the conductive driven element and the conductive coupling element are formed on a same surface of the dielectric substrate. Alternatively, the conductive driven element and the conductive coupling element are formed on opposite surfaces of the dielectric substrate.

Preferably, the dielectric substrate is enclosed by a portion of a housing of a wireless device. Additionally or alternatively, at least one of the conductive driven element and the conductive coupling element is soldered onto pads on the surface of the dielectric substrate.

In accordance with another preferred embodiment of the present invention, at least one of the conductive driven element and the conductive coupling element has planar geometry.

Alternatively, at least one of the conductive driven element and the conductive coupling element has three-dimensional geometry.

Preferably, the conductive coupling element includes a plurality of differently shaped sections.

In accordance with yet another preferred embodiment of the present invention, an antenna assembly includes at least two of the multi-band antennas.

Preferably, the antenna assembly additionally includes at least one decoupling element located between the at least two multi-band antennas.

Preferably, the at least one decoupling element includes a metal strip connected to the conductive ground plane element and the metal strip is bent so as to have three-dimensional geometry.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1A:
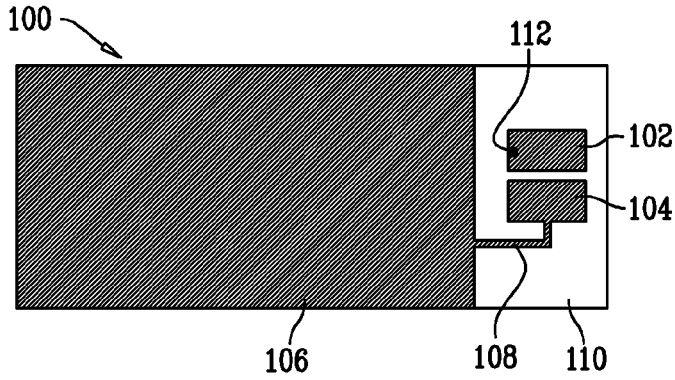
FIG. 1A is a schematic illustration of a multi-band antenna constructed and operative in accordance with an embodiment of the present invention.
Figure 1B:
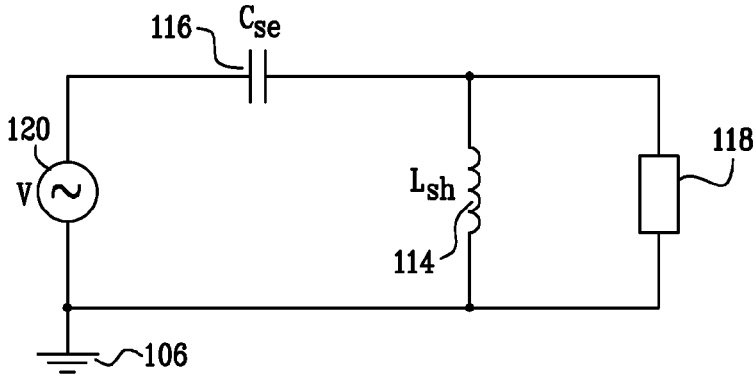
FIG. 1B is a schematic equivalent circuit of a resonant structure thereof.

Reference is now made to FIG. 1A, which is a schematic illustration of a multi-band antenna constructed and operative in accordance with an embodiment of the present invention; and FIG. 1B, which is a schematic equivalent circuit of a resonant structure thereof.

As seen in FIGS. 1A and 1B, there is provided an antenna 100 including a driven conductor element 102 and a coupling conductor element 104, each preferably disposed relative to a ground plane element 106. Coupling conductor element 104 is preferably electrically connected to ground plane element 106 via a galvanic connection 108.

Driven conductor element 102, coupling conductor element 104 and ground plane element 106 are preferably formed on a common surface of a substrate 110, which substrate 110 is preferably a planar dielectric substrate which comprises a portion of a PCB. Substrate 110 may alternatively be formed from a variety of dielectric materials other than those conventionally used for PCBs, such as plastics, glasses and ceramics. Substrate 110 may be a dedicated dielectric carrier or may be enclosed by a portion of the housing of a wireless device.

Driven conductor element 102 and coupling conductor element 104 may be printed directly onto the surface of substrate 110 or soldered onto dedicated pads on the surface of substrate 110. Driven conductor element 102 and coupling conductor element 104 may alternatively be applied by a variety of other techniques, including plating, gluing or molding.

Antenna 100 further includes a feed point 112, preferably located on driven conductor element 102, to which a conductor, such as a cable or transmission line from a wireless communication device, may be coupled. It is appreciated that the location of feed point 112 may be varied depending on the topologies of the driven conductor element 102 and ground plane element 106, so as to achieve optimal antenna performance.

Coupling conductor element 104 is preferably spaced away from and located adjacent to driven conductor element 102. By way of example in FIG. 1A, coupling conductor element 104 is illustrated as lying below and parallel to driven conductor element 102. It is appreciated, however, that coupling conductor element 104 may be positioned on any side of driven conductor element 102, including to the left, right, above, below, front or rear. Furthermore, the driven conductor element 102 and coupling conductor element 104 may be located in the same or different planes and at any angle relative to each other, by way of attachment of the elements to angled pads on the surface of substrate 110.

The location of coupling conductor element 104 on a side of driven conductor element 102 differs from the typical arrangement of driven and coupling elements employed in multi-band antennas, in which the coupling element is required to surround the driven element. This requirement makes such antennas difficult to design, due to device size constraints. In contrast, the location of the coupling element on a side of the driven element, as shown in FIG. 1A, facilitates easier optimal fit of antenna 100 to a wireless device.

Driven conductor element 102 preferably has a predetermined length such that it operates as a ¼ wavelength monopole conductor and thus radiates efficiently in a high frequency band of operation of antenna 100. Coupling conductor element 104 preferably capacitively couples to driven conductor element 106, thereby forming a resonant structure, which radiates efficiently in a low frequency band of operation of antenna 100.

The resonant frequency associated with the coupling conductor element 104 may be described in terms of an equivalent circuit, preferably including an inductor 114, having shunt inductance $L_{sh}$ corresponding to the shunt inductance of coupling conductor element 104 to ground 106, and a capacitor 116, having series capacitance $C_{se}$ corresponding to the coupling capacitance between driven conductor element 102 and coupling conductor element 104. The equivalent circuit is preferably completed by a radiation resistance 118 and an AC voltage source 120.

The resonant frequency $f_0$ associated with coupling conductor element 104 has been found to be preferably determined by the series capacitance $C_{se}$ and shunt inductance $L_{sh}$ in accordance with the equation:

$$f_0 = \frac{1}{2\pi\sqrt{C_{se}L_{sh}}} \tag{1}$$

The parameters determining the resonant frequency are well defined and the resonant frequency of coupling conductor element 104 may thus be readily controlled by way of appropriate adjustment of these parameters. This is in contrast to comparable conventional multi-band antennas employing coupling and driven elements, in which there are typically no clearly defined parameters determining the frequency of the resonant mode associated with the coupling element. This makes antenna design for particular frequencies of operation difficult and inefficient, since trial-and-error methods must be used.

As apparent from equation (1), resonant frequency $f_0$ is preferably independent of the size of ground 106. This is particularly advantageous when a very low resonant frequency is required, since a resonant structure having appropriate capacitance and inductance values may be created in a space much smaller than that needed to satisfy typical ground size requirements of multi-band antennas.

Figure 2A:
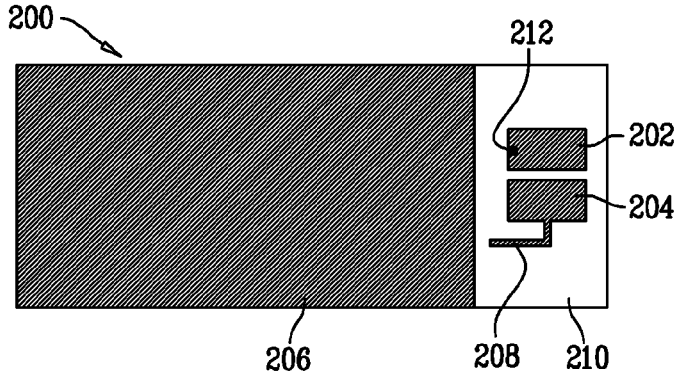
FIG. 2A is a schematic illustration of a multi-band antenna constructed and operative in accordance with another embodiment of the present invention.
Figure 2B:
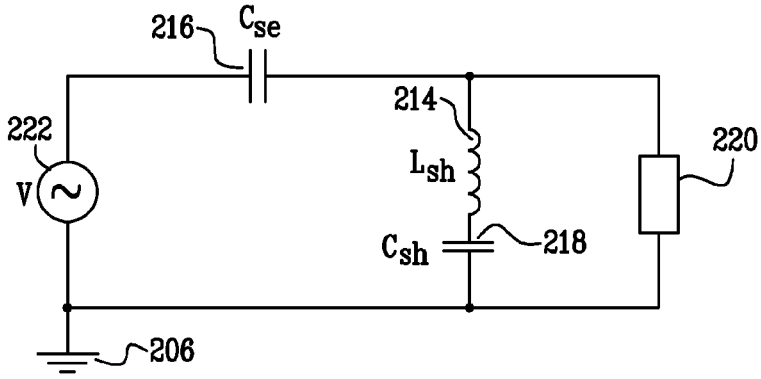
FIG. 2B is a schematic equivalent circuit of a resonant structure thereof.

Reference is now made to FIG. 2A, which is a schematic illustration of a multi-band antenna constructed and operative in accordance with another embodiment of the present invention; and FIG. 2B, which is a schematic equivalent circuit of a resonant structure thereof.

As seen in FIGS. 2A and 2B, there is provided an antenna 200 including a driven conductor element 202 and a coupling conductor element 204, each preferably disposed relative to a ground plane element 206. Antenna 200 resembles antenna 100 in every respect, with the exception of the nature of the coupling of coupling conductor element 204 to ground plane element 206. In contrast to antenna 100, in which coupling conductor element 104 is preferably galvanically connected to ground plane element 106, in antenna 200 coupling conductor element 204 is preferably capacitively coupled to ground plane element 206, via a capacitive connection 208.

Antenna 200 additionally includes substrate 210 and a feed point 212, details of which are as described above in reference to the parallel features of antenna 100.

The resonant frequency associated with the coupling conductor element 204 may be described in terms of an equivalent circuit, preferably including an inductor 214, having shunt inductance $L_{sh}$ corresponding to the shunt inductance of coupling conductor element 204 to ground 206, a first capacitor 216, having series capacitance $C_{se}$ corresponding to the coupling capacitance between driven conductor element 202 and coupling conductor element 204 and a second capacitor 218, having shunt capacitance $C_{sh}$ corresponding to the shunt capacitance of coupling conductor element 204 to ground 206. Shunt capacitance $C_{sh}$ arises from the capacitive coupling between coupling conductor element 204 and the ground 206 and hence is not present in the circuit corresponding to antenna 100, in which no such capacitive coupling between the coupling conductor element 204 and ground 206 is present.

The equivalent circuit of antenna 200 is preferably completed by a radiation resistance 220 and an AC voltage source 222.

The resonant frequency $f_0$ associated with coupling conductor element 204 has been found to be preferably determined by the series capacitance $C_{se}$, shunt inductance $L_{sh}$ and shunt capacitance $C_{sh}$, in accordance with the equation:

$$f_0 = \frac{1}{2\pi\sqrt{C_{eff} L_{sh}}} \tag{2}$$

where $C_{eff}$ is the equivalent capacitance corresponding to $C_{se}$ and $C_{sh}$ and is given by:

$$\frac{1}{C_{eff}} = \frac{1}{C_{se}} + \frac{1}{C_{sh}} \tag{3}$$

All other features and advantages of antenna 200 are as described above in reference to antenna 100.

Figure 3A:
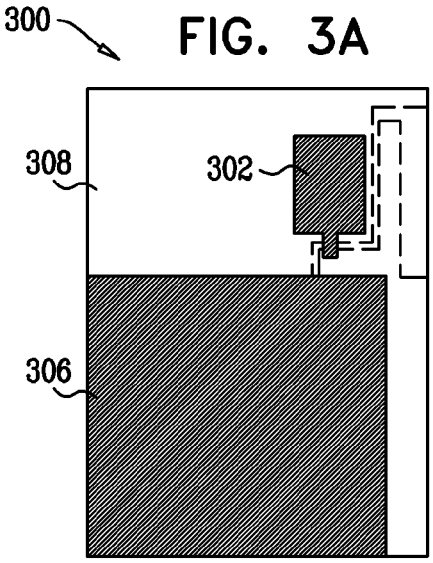
FIGS. 3A and 3B are simplified respective front and rear view illustrations of a multi-band antenna, constructed and operative in accordance with yet another embodiment of the present invention.
Figure 3B:
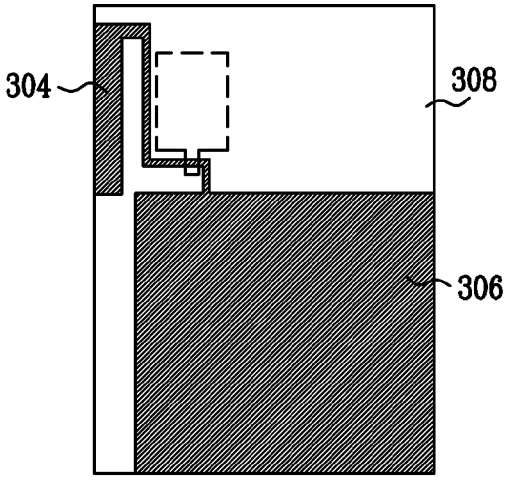

Reference is now made to FIGS. 3A and 3B, which are simplified respective front and rear view illustrations of a multi-band antenna, constructed and operative in accordance with yet another embodiment of the present invention.

As seen in FIGS. 3A and 3B, antenna 300 includes a driven conductor element 302, coupling conductor element 304 and ground plane elements 306. Driven conductor element 302 and one of ground plane elements 306 are preferably formed on a front surface of substrate 308, as seen in FIG. 3A, and coupling conductor element 304 and the other of ground plane elements 306 are preferably formed on formed on a rear surface of substrate 308, as seen in FIG. 3B.

Other details and features of antenna 300 are as described above in reference to antenna 100.

Figure 4A:
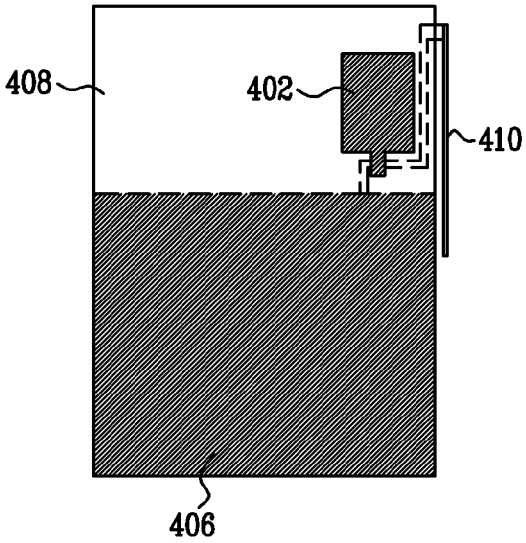
FIGS. 4A, 4B and 4C are simplified respective front, rear and perspective view illustrations of a multi-band antenna, constructed and operative in accordance with still another embodiment of the present invention.
Figure 4B:
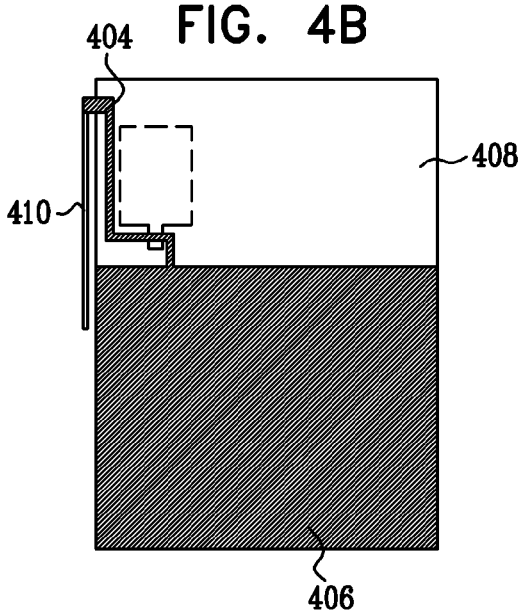
Figure 4C:
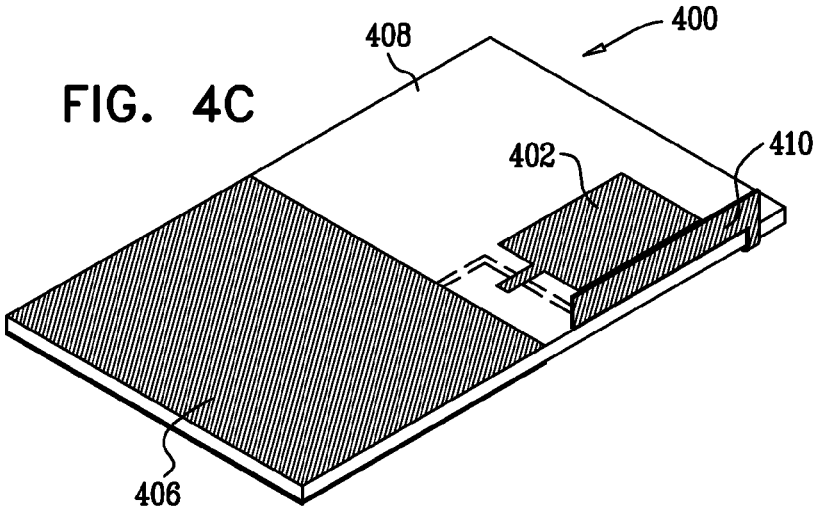

Reference is now made to FIGS. 4A, 4B and 4C, which are simplified respective front, rear and perspective view illustrations of a multi-band antenna, constructed and operative in accordance with still another embodiment of the present invention.

As seen in FIGS. 4A-4C, antenna 400 includes a driven conductor element 402, a coupling conductor element 404 and ground plane elements 406. Driven conductor element 402 and one of ground plane elements 406 are preferably formed on a front surface of substrate 408, as seen in FIGS. 4A and 4C, and coupling conductor element 404 and the other of ground plane elements 406 are preferably formed on a rear surface of substrate 408, as seen in FIG. 4B.

In contrast to antennas 100, 200 and 300, in which coupling conductor elements 104, 204 and 304 have planar geometry, the side arm 410 of coupling conductor element 404 is preferably bent perpendicular to the plane of substrate 408, thus forming a three dimensional structure extending out of the plane of substrate 408.

Coupling conductor element 404 is preferably formed of a stamped metal element, at least a portion of which extends above substrate 408. Alternatively, depending on design requirements, both the driven conductor element 402 and coupling conductor element 404 may have three-dimensional geometry.

It is appreciated that the embodiment of FIGS. 4A-4C is more compact than the embodiments of FIGS. 1A-3B, since coupling conductor element 404 utilizes the height extent of the device into which antenna 400 is incorporated.

Other details and features of antenna 400 are as described above in reference to antenna 100.

Figure 5A:
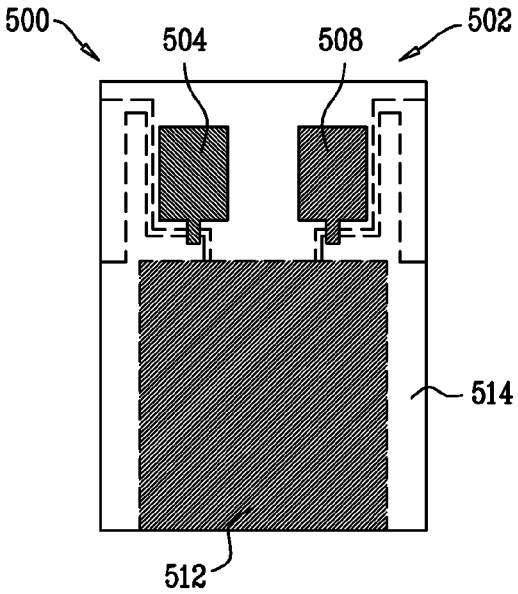
FIGS. 5A and 5B are simplified respective front and rear view illustrations of two closely spaced multi-band antennas of the type illustrated in FIGS. 3A and 3B.
Figure 5B:
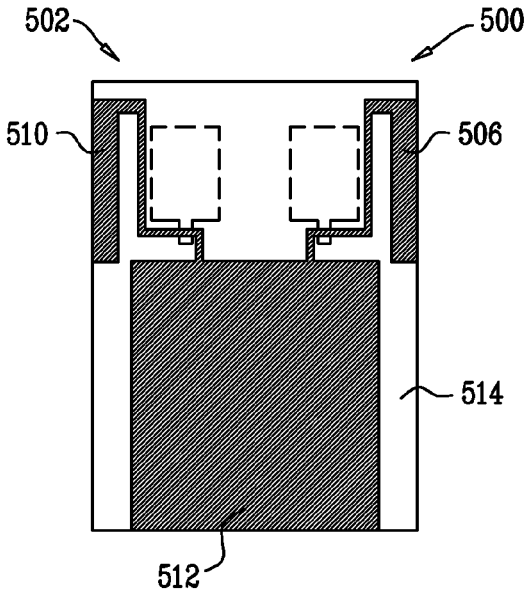

Reference is now made to FIGS. 5A and 5B, which are simplified respective front and rear view illustrations of two closely spaced multi-band antennas of the type illustrated in FIGS. 3A and 3B.

As seen in FIGS. 5A and 5B, antennas 500 and 502 respectively include first driven conductor element 504 and first coupling conductor element 506 and second driven conductor element 508 and second coupling conductor element 510. Antennas 500 and 502 preferably share common ground plane elements 512. First and second driven conductor elements 504 and 508 and one of ground plane elements 512 are preferably formed on a front surface of substrate 514, as seen in FIG. 5A, and first and second coupling conductor elements 506 and 510 and the other of ground plane elements 512 are preferably formed on a rear surface of substrate 514, as seen in FIG. 5B.

It is appreciated that although only two pairs of driven elements and coupling elements are illustrated in the embodiment of FIGS. 5A and 5B, multiple antennas including a greater number of driven and coupling elements are also included within the scope of the invention.

Details and features of each of antennas 500 and 502 are as described above in reference to antenna 300.

Figure 9A:
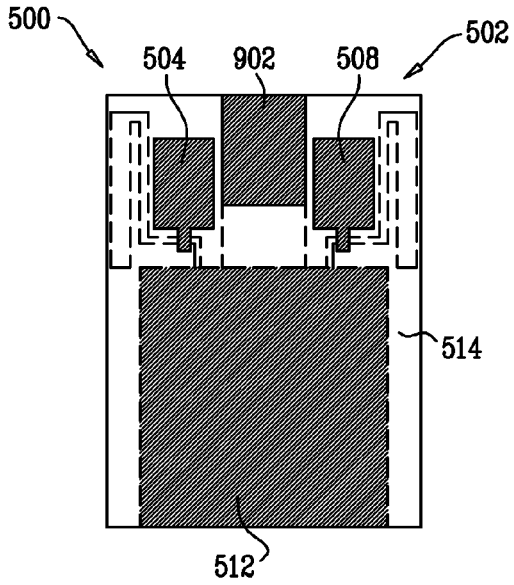
FIGS. 9A and 9B are simplified respective front and rear view illustrations of two closely spaced multi-band antennas of the type illustrated in FIGS. 5A and 5B, separated by a planar decoupling element.
Figure 9B:
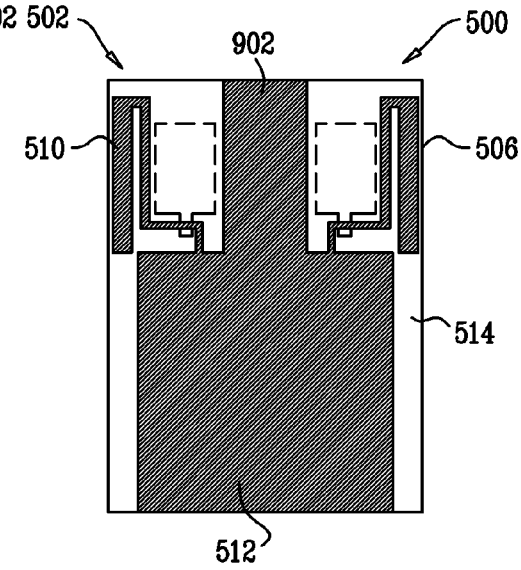

In order to improve antenna isolation and reduce coupling between antennas 500 and 502, a planar decoupling element 902 may be provided, as shown in FIGS. 9A and 9B. Planar decoupling element 902 is preferably formed of a metal strip of predetermined length, which is connected to ground plane element 512 on the rear side of substrate 514, as seen in FIG. 9B. It is appreciated that although only one decoupling element 902 is shown in FIGS. 9A and 9B, the inclusion of more than one such decoupling element is also possible.

Figure 6A:
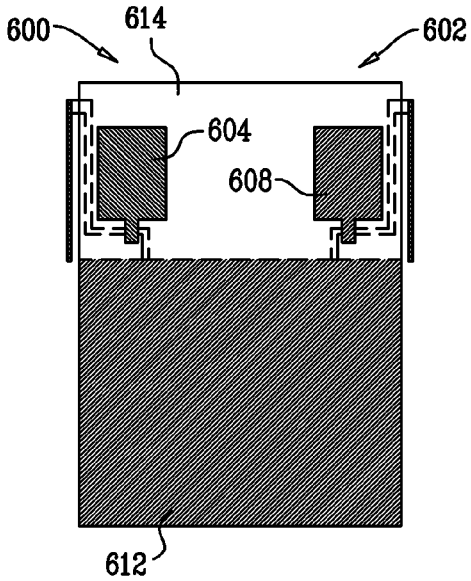
FIGS. 6A, 6B and 6C are simplified respective front, rear and perspective view illustrations of two closely spaced multi-band antennas of the type illustrated in FIGS. 4A-4C.
Figure 6B:
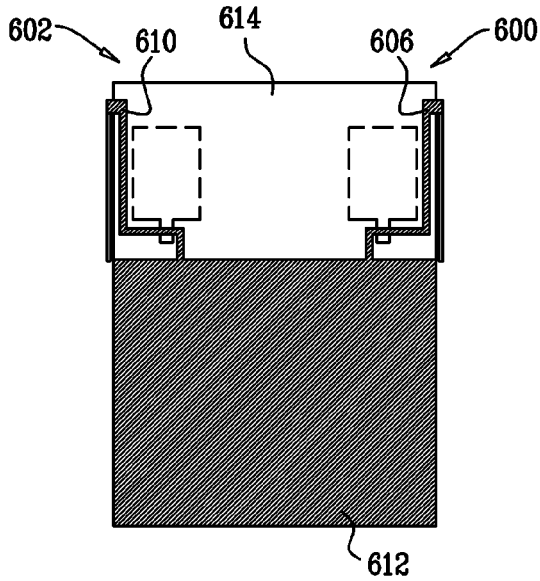
Figure 6C:
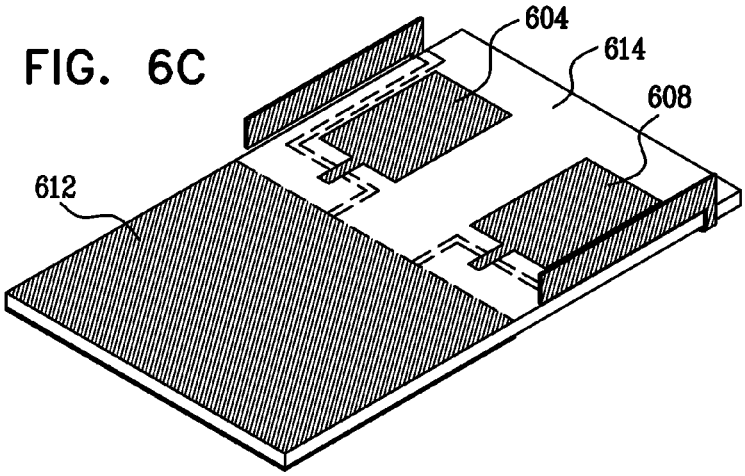

Reference is now made to FIGS. 6A, 6B and 6C, which are simplified respective front, rear and perspective view illustrations of two closely spaced multi-band antennas of the type illustrated in FIGS. 4A-4C.

As seen in FIGS. 6A-6C, antennas 600 and 602 respectively include first driven conductor element 604 and first coupling conductor element 606 and second driven conductor element 608 and second coupling conductor element 610. Antennas 600 and 602 preferably share common ground plane elements 612. First and second driven conductor elements 604 and 608 and one of ground plane elements 612 are preferably formed on a front surface of substrate 614, as seen in FIGS. 6A and 6C, and first and second coupling conductor elements 606 and 610 and the other of ground plane elements 612 are preferably formed on a rear surface of substrate 614, as seen in FIG. 6B.

Details and features of each of antennas 600 and 602 are as described above in reference to antennas 400 and 402.

It is appreciated that although only two pairs of driven elements and coupling elements are illustrated in the embodiment of FIGS. 6A-6C, multiple antennas including a greater number of driven and coupling elements are also included within the scope of the invention.

It is further appreciated that the three-dimensional nature of first and second coupling conductor elements 606 and 610 leads to antennas 600 and 602 being more compact than their planar counterparts 500 and 502. Within a device of given size, the three-dimensional geometry of first and second coupling conductor elements 606 and 610 therefore permits greater separation between the antennas, thereby increasing antenna isolation and improving performance.

Figure 10A:
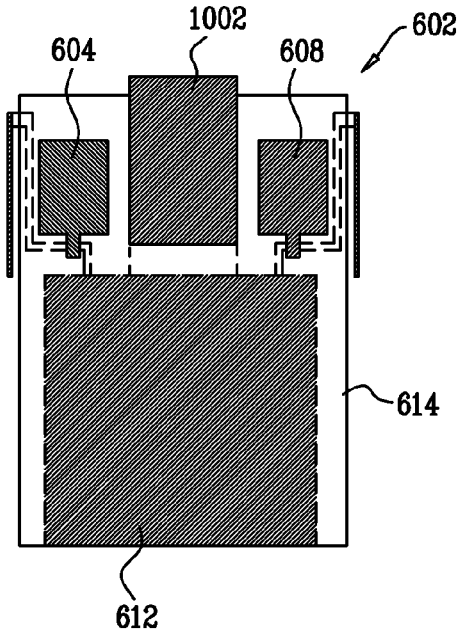
FIGS. 10A, 10B and 10C are simplified respective front, rear and perspective view illustrations of two closely spaced multi-band antennas of the type illustrated in FIGS. 6A, 6B and 6C, separated by a three-dimensional decoupling element.
Figure 10B:
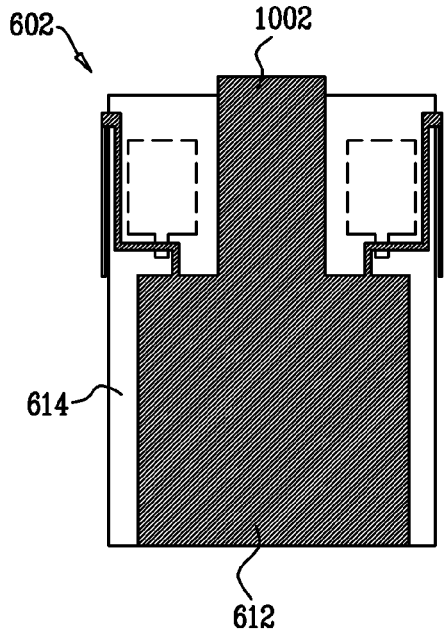
Figure 10C:
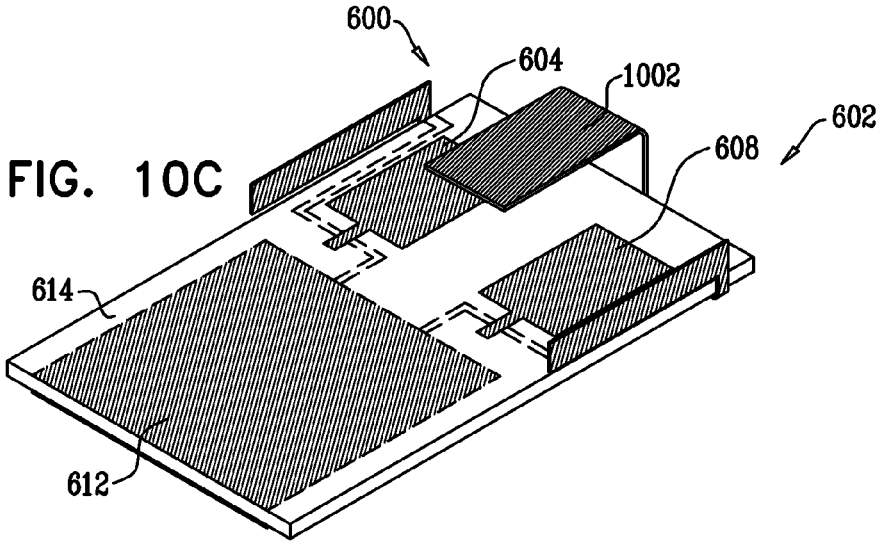

In order to further increase antenna isolation and reduce coupling between antennas 600 and 602, a three-dimensional decoupling element 1002 may be provided, as shown in FIGS. 10A-10C. Decoupling element 1002 is preferably formed of a metal strip of predetermined length, which is connected to ground plane element 612 on the rear surface of substrate 614, as seen in FIG. 10B. The presence of a three-dimensional decoupling element such as decoupling element 1002 has been found to improve antenna isolation by more than 6 dB. The three-dimensional decoupling element 1002 conserves space and provides greater flexibility in antenna design as compared to the planar decoupling element 902 of FIGS. 9A and 9B.

It is appreciated that although only one decoupling element 1002 is shown in FIGS. 10A-10C, the inclusion of more than one such decoupling element is also possible.

Figure 7A:
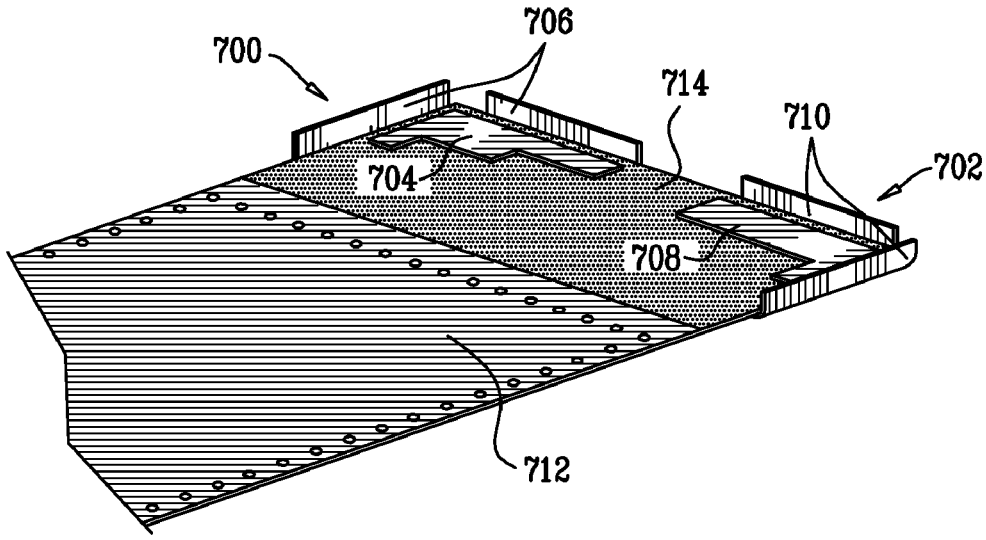
FIGS. 7A and 7B are simplified respective top and underside view illustrations of two closely spaced multi-band antennas, constructed and operative in accordance with yet another embodiment of the present invention.
Figure 7B:
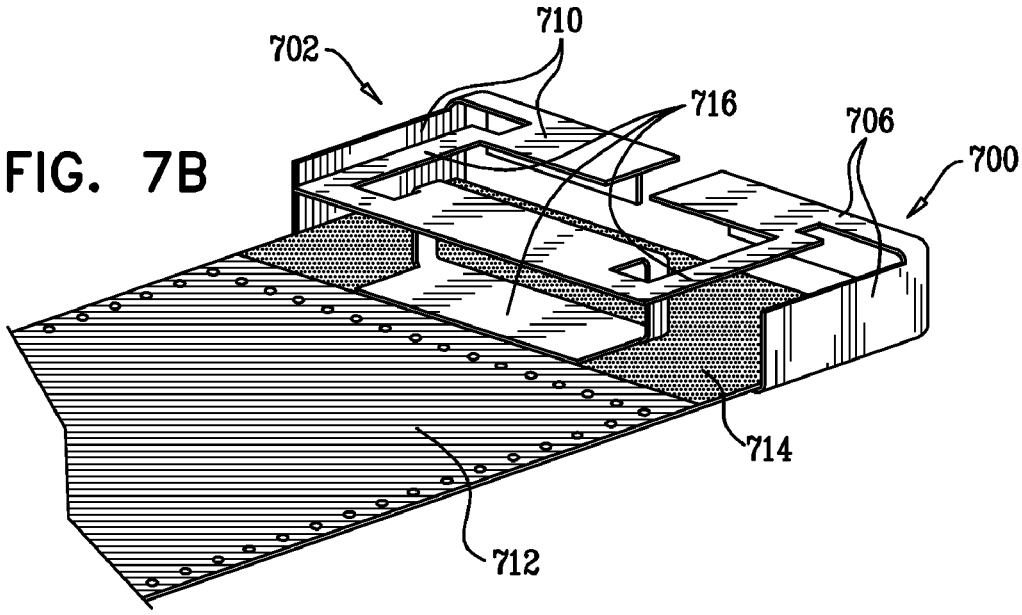

Reference is now made to FIGS. 7A and 7B, which are simplified respective top and underside view illustrations of two closely spaced multi-band antennas, constructed and operative in accordance with yet another embodiment of the present invention.

As seen in FIGS. 7A and 7B, antennas 700 and 702 respectively include first driven conductor element 704 and first coupling conductor element 706 and second driven conductor element 708 and second coupling conductor element 710. Antennas 700 and 702 preferably share common ground plane elements 712. First and second driven conductor elements 704 and 708 and one of ground plane elements 712 are preferably formed on a front surface of substrate 714, as seen in FIG. 7A, and first and second coupling conductor elements 706 and 710 and the other of ground plane elements 712 are preferably formed on a rear surface of substrate 714, as seen in FIG. 7B.

As seen particularly clearly in FIG. 7B, each of first and second coupling conductor elements 706 and 710 has a complex three-dimensional geometry, preferably consisting of interconnected mutually perpendicular metal plates. This complex geometry may be derived via simulation and other tools well known in the art, in order to achieve optimal antenna performance in accordance with the operation requirements of antennas 700 and 702.

Each of first and second coupling conductor elements 706 and 710 is preferably connected to ground plane element 712 on the front surface of substrate 714 via connecting plates 716, which connecting plates 716 are preferably joined together in order to provide mechanical stability to the three-dimensional structure.

Operation of the two antennas of FIGS. 7A and 7B are as outlined above in reference to antenna 100.

Figure 8A:
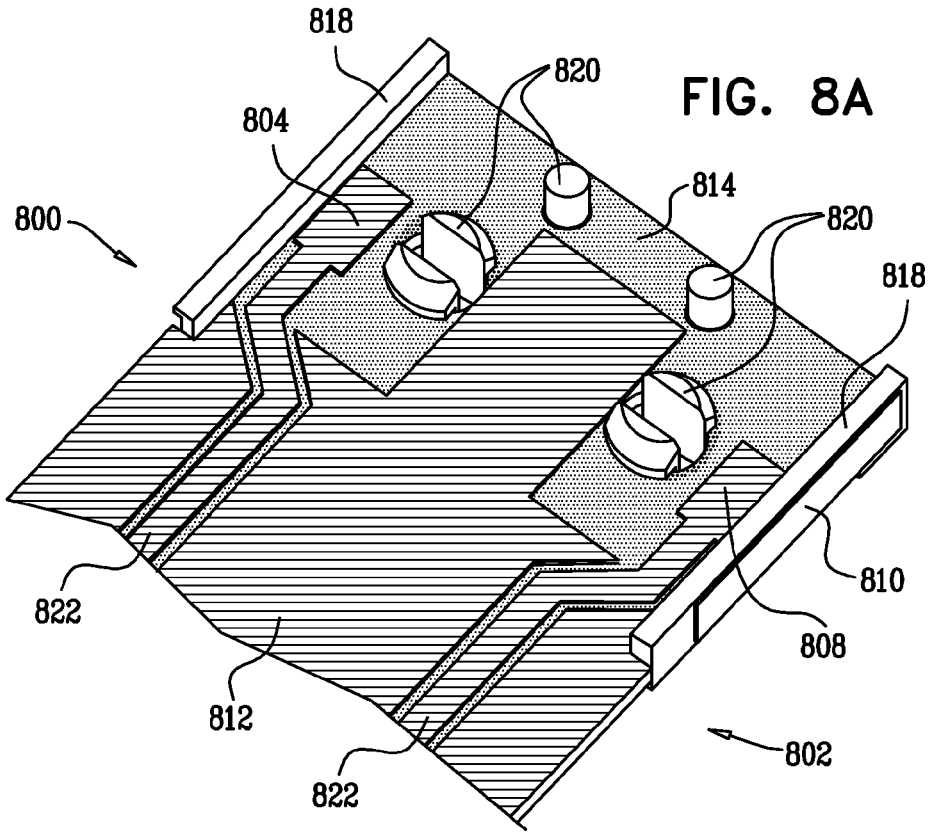
FIGS. 8A and 8B are simplified respective top and underside view illustrations of two closely spaced multi-band antennas, constructed and operative in accordance with yet a further embodiment of the present invention.
Figure 8B:
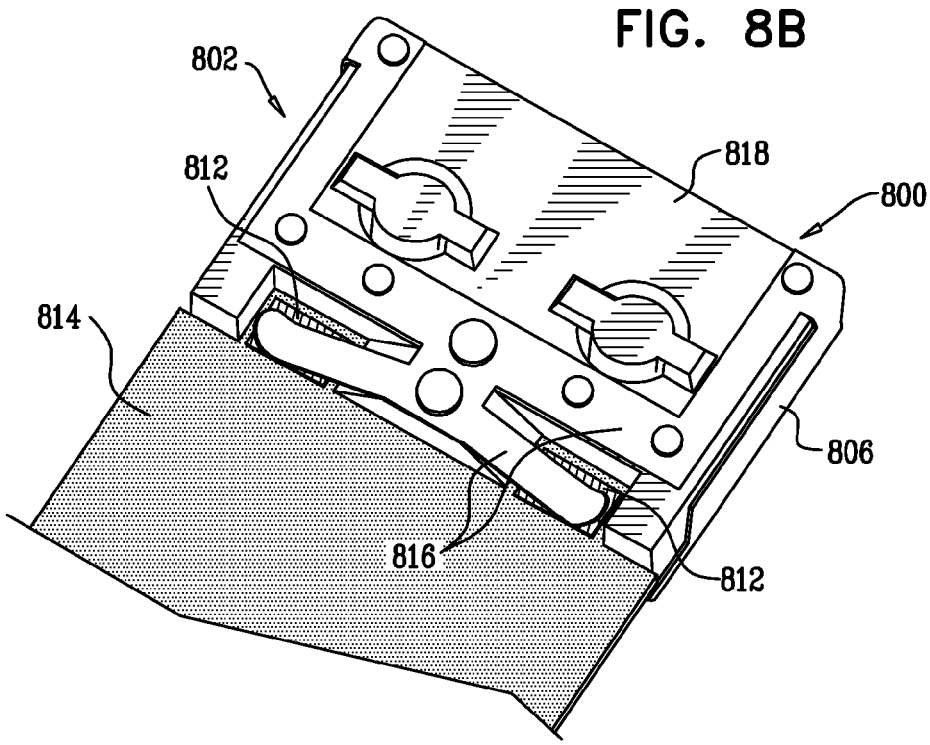

Reference is now made to FIGS. 8A and 8B, which are simplified respective top and underside view illustrations of two closely spaced multi-band antennas, constructed and operative in accordance with yet a further embodiment of the present invention As seen in FIGS. 8A and 8B, antennas 800 and 802 respectively include first driven conductor element 804 and first coupling conductor element 806 and second driven conductor element 808 and second coupling conductor element 810. Antennas 800 and 802 preferably share common ground plane elements 812. First and second driven conductor elements 804 and 808 and one of ground plane elements 812 are preferably formed on a front surface of substrate 814, as seen in FIG. 8A.

First and second coupling conductor elements 806 and 810 are preferably in the form of rectangular plates, extending along and perpendicular to edges of substrate 814. Each of first and second coupling conductor elements 806 and 810 is preferably connected to ground plane elements 812 on a rear surface of substrate 814 via a commons structure 816. Commons structure 816 is preferably mounted on plastic carrier 818 having PCB mounting features 820. This design enhances the mechanical stability of the three-dimensional structure.

First and second driven conductor elements 804 and 808 are preferably fed by transmission lines 822. Alternatively, first and second driven conductor elements 804 and 808 may be fed by cables.

Other features and advantages of the two antennas of FIGS. 8A and 8B are as outlined above in reference to antennas 600 and 602.

It will be appreciated by persons skilled in the art that the present invention is not limited by what has been particularly claimed hereinbelow. Rather the scope of the present invention includes various combinations and subcombinations of the features described hereinabove as well as modifications and variations thereof as would occur to persons skilled in the art upon reading the foregoing description with reference to the drawings and which are not in the prior art. In particular, it will be appreciated that the shape of the driven and coupling elements shown in FIGS. 1A-10C is shown by way of example only and that the driven and coupling elements may be embodied in a variety of different forms.

The invention claimed is:

1. A multi-band antenna comprising:

a conductive ground plane element;

a conductive driven element having a feed point; and a conductive coupling element located on at least one but not all sides of said conductive driven element and coupled to said conductive ground plane element and to said conductive driven element;

wherein a resonant frequency associated with said conductive coupling element is independent of a size of said conductive ground plane element.

2. A multi-band antenna of claim 1, wherein said conductive driven element and said conductive coupling element are configured so that said conductive driven element radiates in a first frequency band and said conductive driven element together with said conductive coupling element radiate in a second frequency band.

3. A multi-band antenna of claim 2, wherein said first frequency band is higher than said second frequency band.

4. A multi-band antenna of claim 3, wherein said conductive driven element comprises a ¼ wavelength monopole radiator.

5. A multi-band antenna of claim 1, wherein said conductive coupling element is galvanically coupled to said conductive ground plane element and wherein said resonant frequency associated with said conductive coupling element depends only on $C_{se}$ and $L_{sh}$, wherein $C_{se}$ corresponds to a coupling capacitance between said conductive driven element and said conductive coupling element and $L_{sh}$ corresponds to a shunt inductance of said conductive coupling element to said conductive ground plane element.

6. A multi-band antenna of claim 5, wherein said resonant frequency associated with said conductive coupling element is given by $$\frac{1}{2\pi\sqrt{C_{se}L_{sh}}}.$$

7. A multi-band antenna of claim 1, wherein said conductive coupling element is capacitively coupled to said conductive ground plane element and wherein said resonant frequency associated with said conductive coupling element depends only on $C_{se}$, $L_{sh}$ and $C_{sh}$, wherein $C_{se}$ corresponds to a coupling capacitance between said conductive driven element and said conductive coupling element, $L_{sh}$ corresponds to a shunt inductance of said conductive coupling element to said conductive ground element and $C_{sh}$ corresponds to a shunt capacitance of said conductive coupling element to said conductive ground plane element.

8. A multi-band antenna of claim 7, wherein said resonant frequency associated with said conductive coupling element is given by wherein $$\frac{1}{2\pi\sqrt{C_{eff}L_{sh}}},$$

wherein $$\frac{1}{C_{eff}} = \frac{1}{C_{se}} + \frac{1}{C_{sh}}.$$

9. A multi-band antenna of claim 1, wherein said conductive driven element and said conductive coupling element are formed on a surface of a dielectric substrate.

10. A multi-band antenna of claim 9, wherein said dielectric substrate comprises a portion of a PCB.

11. A multi-band antenna of claim 9, wherein said dielectric substrate comprises a dielectric material selected from a group of materials including plastics, glasses and ceramics.

12. A multi-band antenna of claim 9, wherein said conductive driven element and said conductive coupling element are formed using a technique selected from a group of techniques including printing, plating, gluing and molding.

13. A multi-band antenna of claim 9, wherein said conductive driven element and said conductive coupling element are formed on a same surface of said dielectric substrate.

14. A multi-band antenna of claim 9, wherein said conductive driven element and said conductive coupling element are formed on opposite surfaces of said dielectric substrate.

15. A multi-band antenna of claim 9, wherein said dielectric substrate is enclosed by a portion of a housing of a wireless device.

16. A multi-band antenna of claim 9, wherein at least one of said conductive driven element and said conductive coupling element is soldered onto pads on said surface of said dielectric substrate.

17. A multi-band antenna of claim 1, wherein at least one of said conductive driven element and said conductive coupling element has planar geometry.

18. A multi-band antenna of claim 1, wherein at least one of said conductive driven element and said conductive coupling element has three-dimensional geometry.

19. A multi-band antenna of claim 18, wherein said conductive coupling element includes a plurality of differently shaped sections.

20. An antenna assembly, including at least two of the multi-band antennas of claim 1.

21. An antenna assembly of claim 20, additionally including at least one decoupling element located between said at least two multi-band antennas.

22. An antenna assembly of claim 21, wherein said at least one decoupling element comprises a metal strip connected to said conductive ground plane element.

23. An antenna assembly of claim 22, wherein said metal strip is bent so as to have three-dimensional geometry.

* * * * *